US009260217B2

(12) United States Patent
Niec et al.

(10) Patent No.: US 9,260,217 B2
(45) Date of Patent: Feb. 16, 2016

(54) CAN END FOR A CAN AND SUCH CAN

(75) Inventors: Philippe Gérard Stanislas Niec, Sablé-sur Sarthe (FR); Jean-Marc Nicolas Legresy, La Fleche (FR); Franck Philippe Dathy, La Mans (FR)

(73) Assignee: Impress Group B.V., Deventer (NL)

( * ) Notice: Subject to any disclaimer, the term of this patent is extended or adjusted under 35 U.S.C. 154(b) by 1665 days.

(21) Appl. No.: 12/162,400

(22) PCT Filed: Jan. 30, 2007

(86) PCT No.: PCT/EP2007/000897

§ 371 (c)(1),
(2), (4) Date: Dec. 11, 2008

(87) PCT Pub. No.: WO2007/085499

PCT Pub. Date: Aug. 2, 2007

(65) Prior Publication Data

US 2010/0059530 A1 Mar. 11, 2010

(30) Foreign Application Priority Data

Jan. 30, 2006 (EP) ..... 06075219

(51) Int. Cl.
*B65D 6/28* (2006.01)
*B65D 17/00* (2006.01)

(52) U.S. Cl.
CPC ..... *B65D 17/163* (2013.01); *B65D 2517/0016* (2013.01); *B65D 2517/0062* (2013.01)

(58) Field of Classification Search
CPC ..... B65D 7/36
USPC ..... 220/623, 619, 906, 624, 608, 620, 609, 220/610; 413/4, 8, 12, 14, 15, 16, 17, 25
See application file for complete search history.

(56) References Cited

U.S. PATENT DOCUMENTS

| | | | |
|---|---|---|---|
| 3,843,014 | A | 10/1974 | Cospen et al. |
| 3,905,507 | A | 9/1975 | Lyu |
| 4,031,837 | A | 6/1977 | Jordan |
| 4,093,102 | A | 6/1978 | Kraska |
| 4,147,271 | A | 4/1979 | Yamaguchi |

(Continued)

FOREIGN PATENT DOCUMENTS

| | | |
|---|---|---|
| AU | 1736976 | 3/1978 |
| EP | 0906222 B1 | 4/1999 |

(Continued)

OTHER PUBLICATIONS

Cover sheet of the "BPE Customer Information Manual" from Ball Packaging Europe (BPE) of the year 2005, 1 page.

(Continued)

*Primary Examiner* — Jacob K Ackun
*Assistant Examiner* — Jenine Pagan
(74) *Attorney, Agent, or Firm* — The Webb Law Firm

(57) ABSTRACT

The invention relates to a can end for a can, such as an easy opening can, comprising: a central panel; a can end radius for connection to a body of the can; and a countersink connected via a transition wall to the can end radius and via a panel wall to the panel; wherein a panel wall angle is 2°-45°; a panel radius is larger than 0.5 mm; a panel depth is 1 mm-7 mm; and a countersink radius is less than 5 mm; and to cans provided with at least one such a can end.

20 Claims, 13 Drawing Sheets

(56) References Cited

U.S. PATENT DOCUMENTS

| | | | | |
|---|---|---|---|---|
| 4,217,843 | A | 8/1980 | Kraska | |
| 4,448,322 | A | 5/1984 | Kraska | |
| 4,790,705 | A | 12/1988 | Wilkinson et al. | |
| 4,809,861 | A | 3/1989 | Wilkinson et al. | |
| 5,836,473 | A * | 11/1998 | Jentzsch et al. | 220/606 |
| 6,460,723 | B2 * | 10/2002 | Nguyen et al. | 220/619 |
| 6,516,968 | B2 * | 2/2003 | Stodd | 220/623 |
| 6,736,283 | B1 * | 5/2004 | Santamaria et al. | 220/619 |
| 6,748,789 | B2 * | 6/2004 | Turner et al. | 72/379.4 |
| 2002/0134788 | A1 | 9/2002 | Nguyen et al. | |
| 2002/0190071 | A1 * | 12/2002 | Neiner | 220/619 |
| 2003/0121920 | A1 * | 7/2003 | Zonker et al. | 220/269 |
| 2003/0173367 | A1 * | 9/2003 | Nguyen et al. | 220/669 |
| 2004/0074911 | A1 * | 4/2004 | Stodd | 220/619 |
| 2004/0094559 | A1 | 5/2004 | Santamaria et al. | |
| 2005/0029269 | A1 | 2/2005 | Stodd et al. | |

FOREIGN PATENT DOCUMENTS

| | | | |
|---|---|---|---|
| EP | 1103470 | A1 | 5/2001 |
| EP | 0906222 | B1 | 8/2003 |
| JP | 5548037 | A | 4/1980 |
| JP | 6143109 | U | 3/1986 |

OTHER PUBLICATIONS

Product information sheet from Ball Packaging Europe, 04 501 02 13, edition 6/3-11-14, 2005, 1 page.

Product information sheet from Schmalbach-Lubeca, 04 501 02 13, edition 3/98-09-18, 1 page.

Product information sheet from Continental Can Europe, 04 501 02 13, edition 1/97-02-03, 1 page.

* cited by examiner

CAN END FOR A CAN AND SUCH CAN

BACKGROUND OF THE INVENTION

1) Field of the Invention

The present invention relates to a can end for a can, such as an easy opening can, and to such a can provided with at least one such a can end.

Such cans are intended for use as a beverage can and as a food can.

2) Description of Related Art

Generally, beverage cans are thin walled (0.04-0.15 mm). Such a beverage can obtains its strength (after filling and closure) by an internally build up pressure. To that extent the can is filled and provided with gas generating material. After closure, gas formation results in the internal build up of pressure.

Generally, food cans are provided with food which may have to be subjected to a pasteurization or sterilization procedure. Accordingly, pressure build up may be temporary during such procedure. However, due to undesired circumstances bacterial growth might result in internal pressure build up after the food can was filled and closed.

In relation to both food cans and beverage cans improper processing filling and handling of such cans may result in temporary or continuous pressure build up which may result in a deformation of in particular the can closure at the top end and/or the bottom end. Accordingly, overfilling the can with the content material, too high processing temperatures, unsatisfactory cooling operations, insufficient vacuum drawing in the can, pre-process spoilage of content, gas formation due to an undesired reaction between can metal and the content resulting in gas formation such as hydrogen gas, and incorrect handling resulting in impacting on the can may result in continuous or temporary pressure build up. These pressure build ups may result in a deformation of the can ends to an extent dependent on the pressure build up.

One form of localized distortion of the can end is buckling or pleating resulting in a local distortion which could extent into the counter sink and seaming region. The bulked portion may even locally extent beyond the perimeter of the can. Higher pressure build up may result in bulging or even the formation of a so called springer. Such bulges may be forced back into the normal can end position. A hard blow will result in a severe and permanent outbulging of one or both ends of the can.

In this respect it is noted that can ends may be designed such that due to pressure build up the concave can end flips out into a convex form (see for instance EP 0 906 222).

SUMMARY OF THE INVENTION

The present invention has for its object to provide a can end for a can, such as an easy opening can, which sustains higher internal pressures than a conventional can end while managing volume expansion. The can end of the invention has a form such that the resistance of the can end to distortion due to pressure build up is improved. For instance, a can provided with a can end according to the invention having a diameter ranging from 45-260 mm may resist pressures built up to more than 2 bar preferably up to more than 3-4 bar or even up to more than 5 bar. But, if a pre-designed pressure build up is surpassed, then the can end will distort but such that its form will not transform from a concave form into a convex form but will be provided with irregular distortions. Accordingly, the consumer could appreciate that due to the irregular buckled or pleated can end the content may be spoilt and should not be consumed.

The form and shape of the can end according to the invention is having a form and shape designed such that high pressure resistance and/or expansion is obtained preferably at minimum thickness of closure and/or body of the can. The pressure resistance is such that the can end and/or can may undergo a temporary deformation due to the pressure built up. Such a deformation allows temporary increase of internal volume of the can thus minimizing the actual pressure. It also allows inspection of the cans according to the invention at different stages during filling, closing, processing and storing using classical detector systems monitoring the outer shape properties. Accordingly, the opportunity is provided to inspect the cans for too low or too high internal pressure. This will provide relevant information in relation to the closing of the cans in pressurization processes and could detect undesired pressure loss due to leakages or pressure raises due to spoilage.

The present invention is the result of insights based on experimental research so that by particular shaping and dimensioning the can end the above objectives are fulfilled and the above mentioned drawbacks substantially overcome.

Accordingly, the present invention provides a can end for a can, such as an easy opening can, comprising a central panel, a can end radius for connection to a body of the can; and a countersink connected via a transition wall to the can end radius and via a panel wall to the panel, wherein a panel wall angle ($A_2$, $P_2$) is 2°-45°, a panel radius ($R_4$) is larger than 0.5 mm a panel depth ($H_2$) is 1 mm-7 mm, and a counter sink radius ($R_3$) is less than 5 mm.

The panel wall angle $A_2$, $P_2$ is selected within the range of 2°-45°. At a lower angle connecting, such that seaming the can end onto the body may be difficult or problematic. An angle beyond 45° will have an adverse effect on the pressure performance.

The panel radius $R_4$ is larger than 0.5 mm. Below 0.5 mm lacquer applied on the metal may be damaged during the forming of the metal, whereas the resistance to small pleats in the adjacent region towards the panel is insufficient. The panel radius $R_4$ is preferably selected within the range of 1.0-1.5 mm. A panel radius $R_4$ larger than 2 mm may result in a reduction of strength and thereby the occurrence of pleating and buckling in the region towards the counter sink.

The panel depth $H_2$ is within the range of 1 mm-7 mm. Below 1 mm panel depth $H_2$ the panel wall angle $A_2$, $P_2$ will become too large. This will have a negative impact on the pressure resistance. Beyond a panel depth $H_2$ of 7 mm the panel wall angle $P_2$ will become too small whereby the pressure resistance will not be affected anymore.

For a can end intended as a can bottom the optimum panel depth $H_2$ is between 2-5 mm and for a top closure is $H_2$ optimal 2.0-2.5 mm.

The counter sink radius $R_3$ should be less than 5 mm. Otherwise, the strength would be insufficient. A counter sink radius $R_3$ lower than 0.5 mm could result in lacquer cracking during the forming of the metal.

For a can bottom is the counter sink radius $R_3$ preferably within the range of 0.5-1.5 mm. For a can lid is the optimum counter sink radius $R_3$ from 0.5-0.7 mm.

A can end according to the invention having the indicated dimensions and structure will be improved in sustaining higher internal pressures in combination with (temporary) elastic deformation. Pleats and buckles will appear at higher internal pressures and in localized predetermined locations. Furthermore, early buckling or bursting in the case of an easy open end is avoided and still (due to high internal pressures) total can volume expansions up to 30 $cm^3$ (at a can diameter of 73 mm) allowed before failure. Generally the internal pressure resistence ranges to at least 2 bar or more, frequently to more than 3-4 bar and even to more than 5 bar. This applies to cans having a diameter of generally 45-260 mm, preferably in the range of 52-153 mm, such as a practical diameter of 73 mm, 83 mm and/or 99 mm.

For a optimal pressure performance it is preferred that the panel wall angle $A_2$, $P_2$ is 5°-35°.

Smaller pleats and less buckles are formed when the panel radius $R_4$ is selected in the preferred range of 1.0-1.5 mm, or even at 1.25-1.5 mm.

Optimally, the panel depth $H_2$ is selected between 2.0-2.5 mm.

According to one general embodiment the can end according to the invention is a can bottom for a can. In such can bottom the can end radius is connected to the body of the can and forms a foot of the ultimate can. According to an embodiment of the can bottom according to the invention the foot has an end foot radius $R_2$ which is less than 5 mm, preferably 0.5-1.5 mm. The upper limit for the end foot radius $R_2$ is such that an axial load does not generate a rolling in of the profile. Thus this can bottom provides less deformability against axial load. Furthermore, when the can end is used for a can which is subjected to thermal processing of the filled can, the closure according to the invention allows the use in continuous cookers, preferably with a can of which its body wall is provided with a rolling bead. For these applications and handling conditions it is preferred that the end foot radius $R_2$ is within the range of 0.5-1.5 mm.

According to a preferred embodiment of the can bottom according to the invention, the foot has a foot radius $R_{13}$ of less than 5 mm, preferably of 0.5-1.5 mm. Preferably in combination with a food height $H_{11}$ in the range of 1-7 mm, preferably 2-5 mm, the can bottom provides a improved or even perfect stackability of the filled can, in particular those provided with an easy opening top closure. Specially when the load of the upper can is on the top of the seam connecting the can lid to the can body and prevents excess wear on the tab of the can lid and thereby prevention of undesired opening of the can lid.

It is noted that the foot of the can bottom may have an outer foot radius $R_{14}$. The dimensions of the outer foot radius $R_{14}$ depends on the distance between the foot radius $R_{13}$ and the end foot radius $R_2$.

In addition, the properties and resistance to internal pressure and/or allowance of expansion at various can diameters and wall thicknesses, may be further improved when the unit depth ($H_1$) is 2-10 mm, preferably is 5-7 mm.

It is preferred that the can end is provided with a panel outer ring. Such panel outer ring will decrease the sensitivity to pleat formation.

For a can bottom it is preferred that in the can bottom a panel outer ring slope ($A_3$) is 0°-35° and a panel outer ring width ($L_1$) is 0-15 mm. The panel outer ring slope $A_3$ may be up to 35°. A minimum $A_3$ is about 1°. Preferably the panel outer ring slope $A_3$ ranges from 2°-20°. The panel outer ring width $L_1$ is up to 15 mm. A minimum panel outer ring width for improved properties starts from about 0.5 mm or from 1 mm. Preferably $L_1$ is within the range of 1-5 mm.

According to another general embodiment according to the present invention the can end according to the invention is a can lid. It could be an easy opening can lid or any other type of can lid which may require an opener for opening the can.

For optimal properties the can lid according to the invention has the unit depth ($H_1$) is 5-7 mm.

When the can lid is provided with a panel outer ring then it is preferred that in the can lid the panel outer ring slope ($P_3$) is 0°-35° and the panel outer ring width ($L_1$) is 0-15 mm, preferably 1-3 mm, more preferably 1-2 mm. The panel outer ring width $L_1$ for the can lid is less than 15 mm and a minimum width is about 0.5 mm. A preferred range for the outer ring width $L_1$ for the can lid is 1-3 mm, more preferably 1-2 mm.

The panel outer ring slope $P_3$ of the can lid according to the invention is preferably up to 35°. A minimum slope $P_3$ is as from 0.5° more preferably as from 1° or 2°. The general range is therefore from 0.5°-35° preferably 2°-20°.

In both can lid and can bottom there may be an angle with the transition wall. This foot wall angle $A_1$ ranges from 0°-45°, preferably from 2°-35°.

When present the panel outer ring $L_1$ has a width of more than about 0.1 to 0.2 mm. When present the panel outer ring may be provided with the score line. Preferably, the score line is located closer to the panel center than to the counter sink which is optimal for the burst resistance.

Preferably, the panel ring has a slope $A_3$, $P_3$ such that higher internal pressures will less distort the form and structure of the can end. The panel ring slope $A_3$, $P_3$ may be up to 35° which results in a reduction of the formation of pleats. Preferably, the panel ring slope $A_3$, $P_3$ is within the range of 2°-20° whereby the panel is provided with a well rounded shape which is least distorted due to internal pressure build up.

The can end according to the invention may be an easy opening can end for an easy opening can. Thus, for opening the can via a preformed opening defined by a score line in the can end it is preferred that the can end is provided with an opening tab.

According to another aspect of the invention is provided a can which comprises a body and at least one can end according to the invention as described above. In one embodiment of the can according to the invention, the body may be provided at both ends with a can end according to the invention. In another embodiment only the can lid is a can end according to the invention. The can bottom or can lid may be integral with the body of the can and formed by any conventional process such as DWI, DRD and (deep) drawing. In another embodiment the can may be provided with a body and a can lid and with a can bottom which is a can end according to the invention.

Another preferred can according to the invention is a can which is composed of a can lid as described above (preferably with an opening tab and cooperating score line) and with another can lid as described above (not provided with opening means) but functioning as a can bottom. Accordingly, the advantage is obtained that the can lid functioning as a can bottom due to its design has a larger radius and therefore better in internal pressure resistance and allowing more expansion within elastic limits. According to another embodiment the can is provided with a can lid and with a can bottom as described above in relation to the present invention. Either of the can ends may be integral with the body of the can. The other can end is connected to the body of the can by traditional techniques such as seaming.

BRIEF DESCRIPTION OF THE DRAWINGS

Mentioned and other features and characteristics of the can end and can according to the present invention will be further illustrated by means of several embodiments which are given for illustrative purposes and are not intended to limit the present invention to any extend. In particular, cans are illustrated with an easy open end, but of course, such cans could also be realized with one or more sanitary end or more generally a non-easy open end. These embodiments will be described with reference to the annexed drawings in which.

DETAILED DESCRIPTION OF THE PREFERRED EMBODIMENTS

Figure 1:
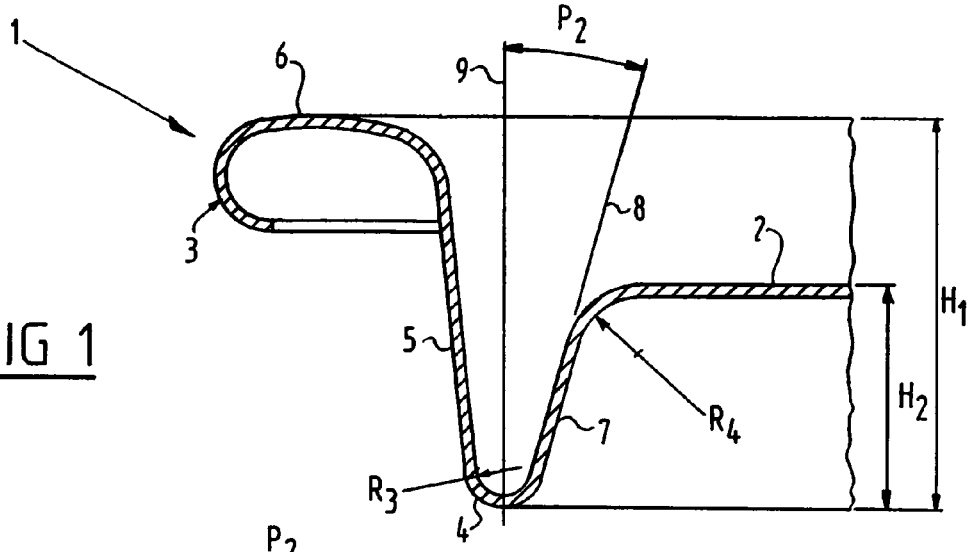
FIGS. 1, 2 and 3 partial cross-sections of can lid according to the invention.

FIG. 1 shows a can lid or can bottom 1 according to the invention. The can end has a central panel 2 and a can end radius or curl 3 for attachment, for instance by seaming, to a body of a can. The can end 1 further comprises a counter sink 4 which is connected via a transition wall 5 to a seaming panel 6 of the curl 3. The counter sink 4 is also connected via a panel wall 7 to the panel 2.

The panel wall angle $P_2$ is determined by the slope 8 of the panel wall 7 relative to the vertical line 9. The panel radius $R_4$ determines the curvature of the connection between the panel wall 7 and the panel 2. The counter sink radius $R_3$ determines the internal curvature of the section between the panel wall 7 and the chuck wall 5. Finally, the panel depth $H_2$ is the distance between the underside of the counter sink and the panel 2 and unit depth $H_1$ the distance between seaming panel 6 and the counter sink underside.

In the can end 1 is the panel wall angle $P_2$ 15°, the panel radius $R_4$ 1.30 mm, the panel depth $H_2$ 2.3 mm and the counter sink radius $R_3$ 0.6 mm.

Figure 2:
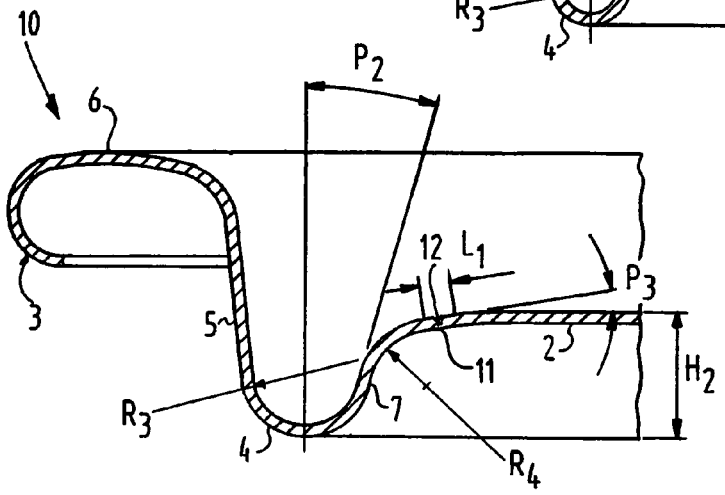

FIG. 2 shows another can end 10 according to the invention.

In comparison to the can end 1 of FIG. 1 is the panel wall angle $P_2$ increased. The panel radius $R_4$ is also increased as well as the counter sink radius $R_3$. The panel depth is also reduced.

As shown in FIG. 2 is the can end 10 further provided with a panel outer ring 11 at the circumference of the panel 2 and connected via the panel wall 7 to the counter sink 4. The outer ring 11 has a width $L_1$ of 1 mm and is provided with a score line 12. The panel outer ring 11 has a slope with the horizontal 13. This panel outer ring slope $P_3$ is 20°.

The dimensions of the can end 10 are panel wall angle $P_2$=30°, panel radius $R_4$=0.8 mm, panel depth $H_2$=1.2 mm, counter sink radius $R_3$ 0.9 mm and panel outer ring width $L_1$ 1.5 mm.

Figure 3:
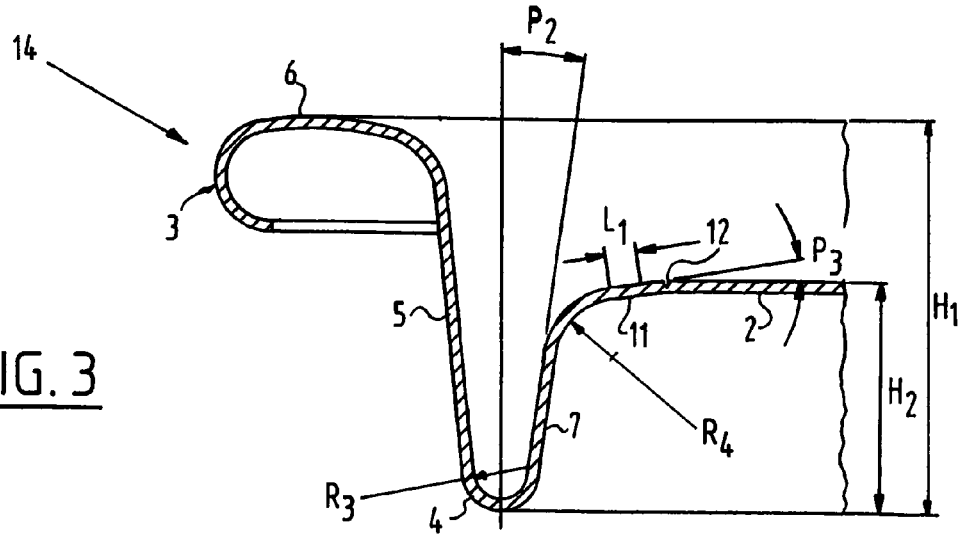

FIG. 3 shows a can end 14 according to the invention. In comparison to the can end 10 illustrated in FIG. 2, the panel wall angle $P_2$ is 10°, the panel radius $R_4$ is 1.8 mm, the panel depth $H_2$ is 2.4 mm and the counter sink radius $R_3$ is 0.6 mm. Furthermore, the outer ring width $L_1$ is 1.5 mm and the outer ring panel slope $P_3$ is 10°.

The following table shows buckle resistance of the can ends 1, 10 and 14 (made of steel) dependent on metal range and metal temper.

| case identification | metal gauge | metal temper | burst pressure |
|---|---|---|---|
| closure 1 of FIG. 1 | 0.23 mm | TH 580 | 4.9 bar |
| closure 10 of FIG. 2 | 0.23 mm | TH 580 | 4.0 bar |
| closure 14 of FIG. 3 | 0.23 mm | TH 580 | 5.1 bar |
| closure 1 of FIG. 1 | 0.24 mm | TH 435 | 4.1 bar |
| closure 10 of FIG. 2 | 0.24 mm | TH 435 | 3.2 bar |
| closure 14 of FIG. 3 | 0.24 mm | TH 435 | 4.4 bar |

Figure 4:
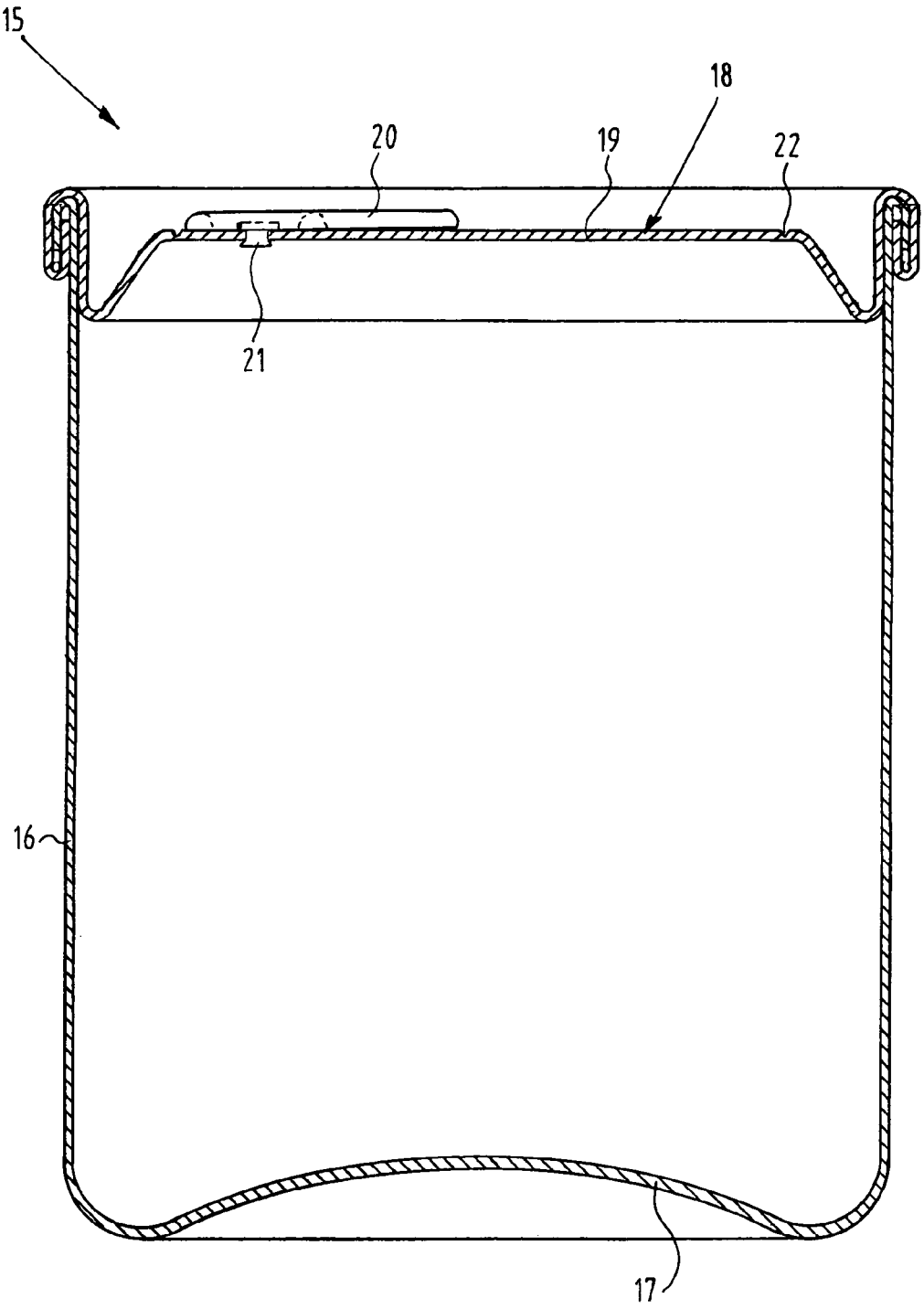
FIG. 4 at a smaller scale a can provided with a can lid according to the invention.

FIG. 4 shows a can according to the invention. The can 15 is provided with a body 16 and an integral concave can bottom 16 of greater wall thickness and a seamed can end 18 according to FIG. 1 (although can ends 10 or 14 of respectively FIGS. 2 and 3 could also have been applied). The panel 19 of the can end 18 is provided with an opening tab 20 connected via a rivet 21 to the panel 19. The panel 19 is further provided with a circular score line 22. Accordingly, the can 15 is an easy opening can for beverage and/or food content.

Figure 5:
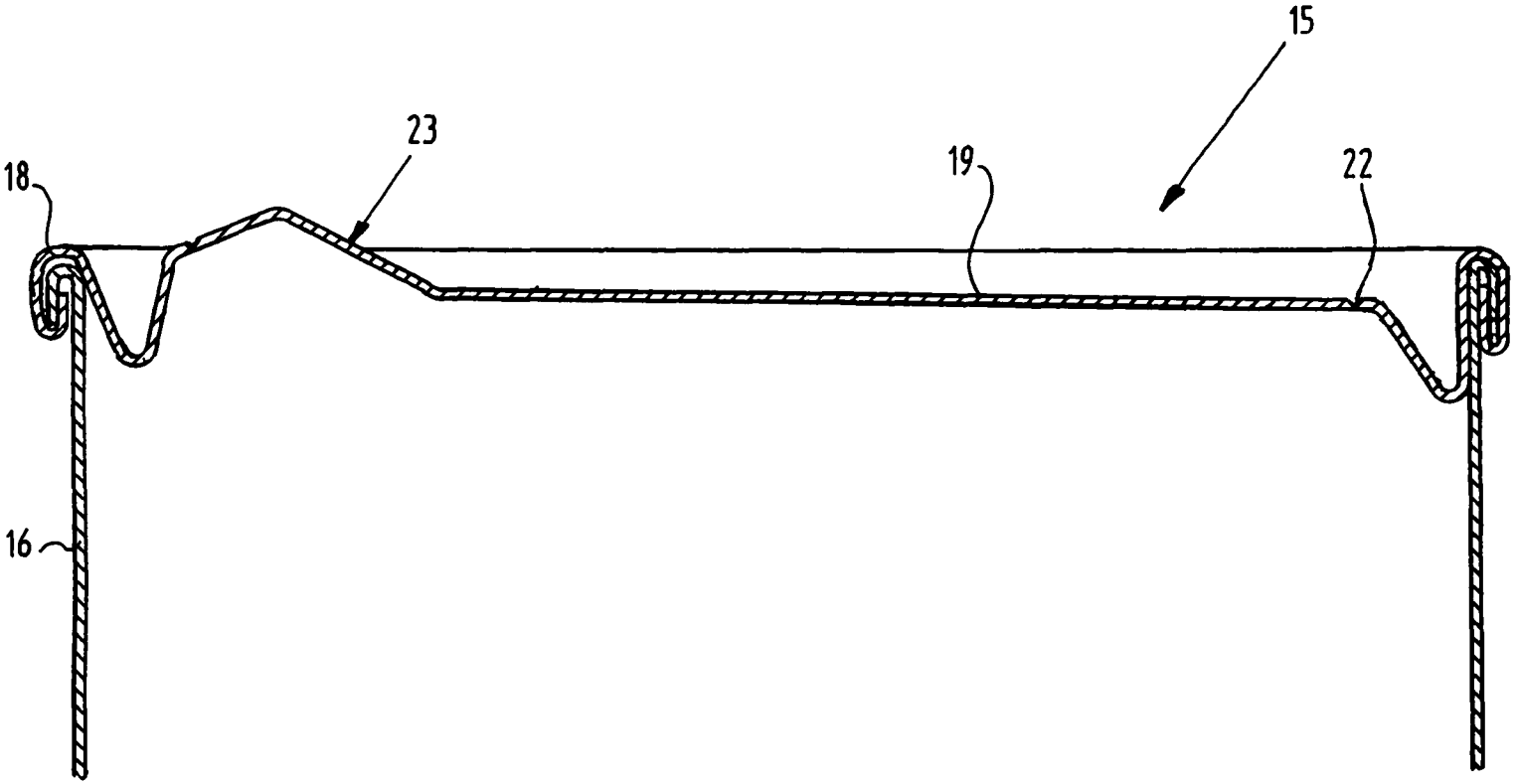
FIG. 5 at a larger scale the can lid of a can having a localized pleated or buckled region due to internal pressure build up.

FIG. 5 shows at a larger scale the can of FIG. 4. Due to undesired pressure development in the closed container 15 a buckle 23 formed locally (over a part of the circumference) in the region between the counter sink and the panel. As illustrated the other regions of the can end 18 are not distorted.

Figure 6:
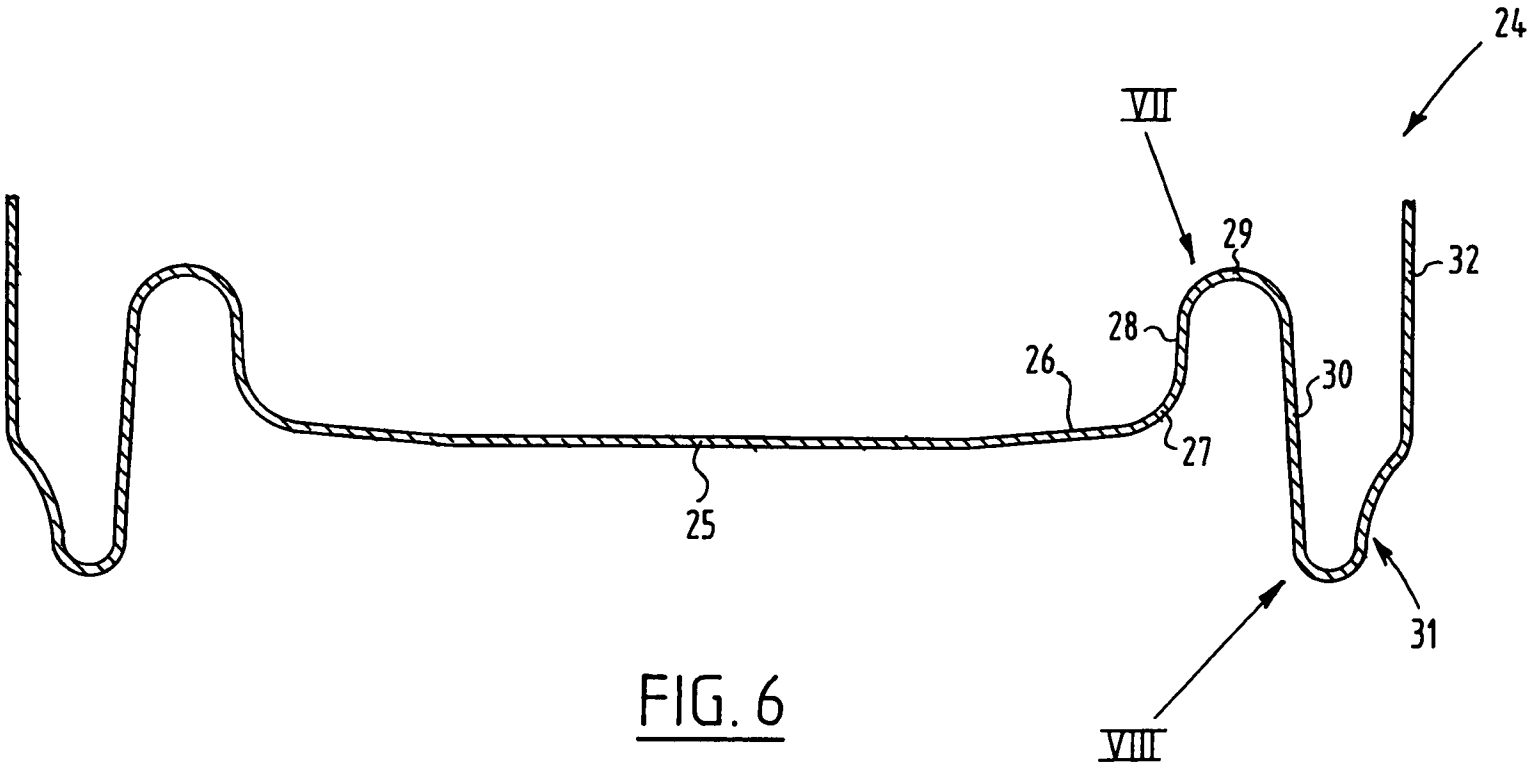
FIG. 6 shows in cross section a can bottom according to the invention.

FIG. 6 shows a can bottom 24 of the invention which is integrally connected to a body of the can. The can bottom 24 comprises a central panel 25 which is provided with a outer panel ring 26 which is connected via a panel radius 27 to a panel wall 28 which via a counter sink radius 29 is connected to a transition wall 30. The transition wall 30 is connected via an end/foot radius 31 to the body wall 32. The details of the can bottom 24 are shown in FIGS. 7 and 8.

The minimal value of the outer radius $R_{14}$ is dependent on the distance between the food radius $R_{13}$ and the end food radius $R_2$.

Figure 7:
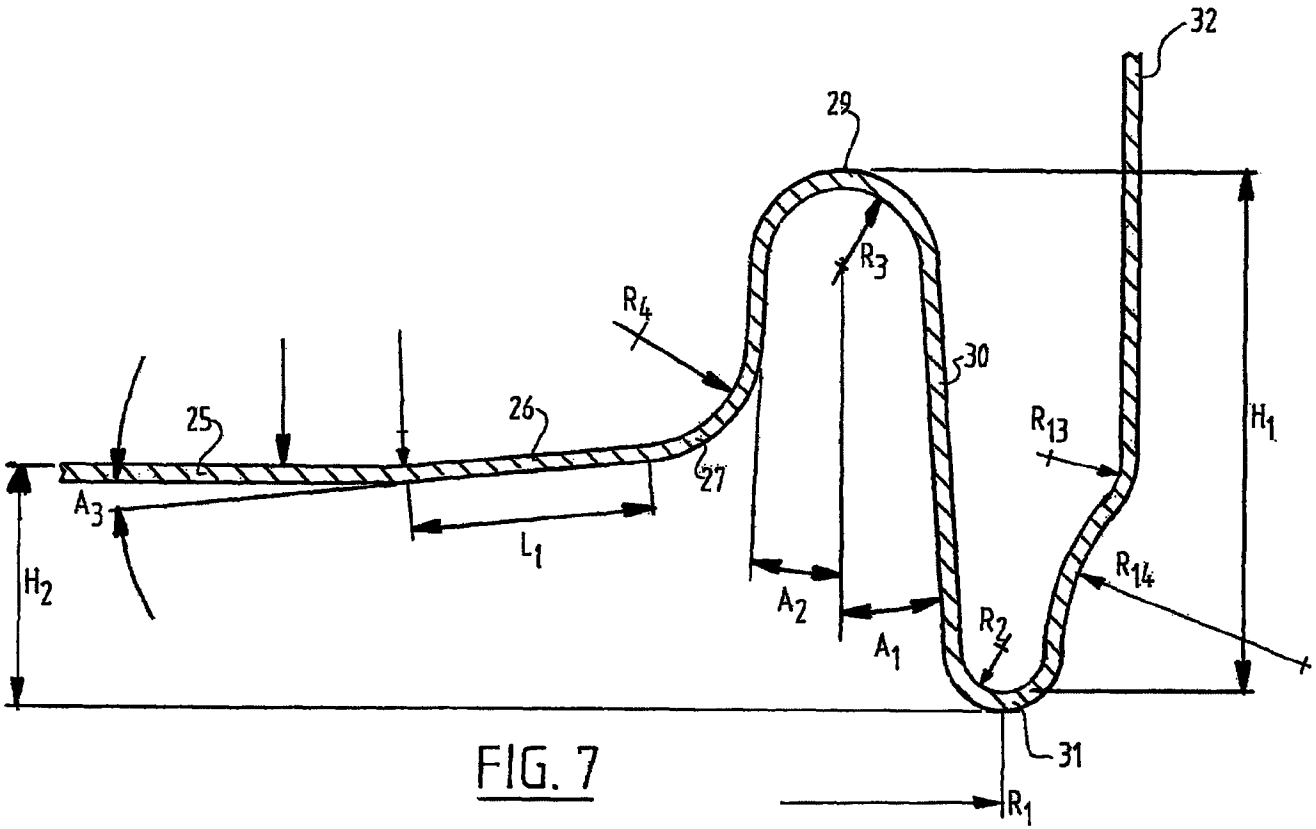
FIGS. 7-8 are details VII and VIII of FIG. 6.
Figure 8:
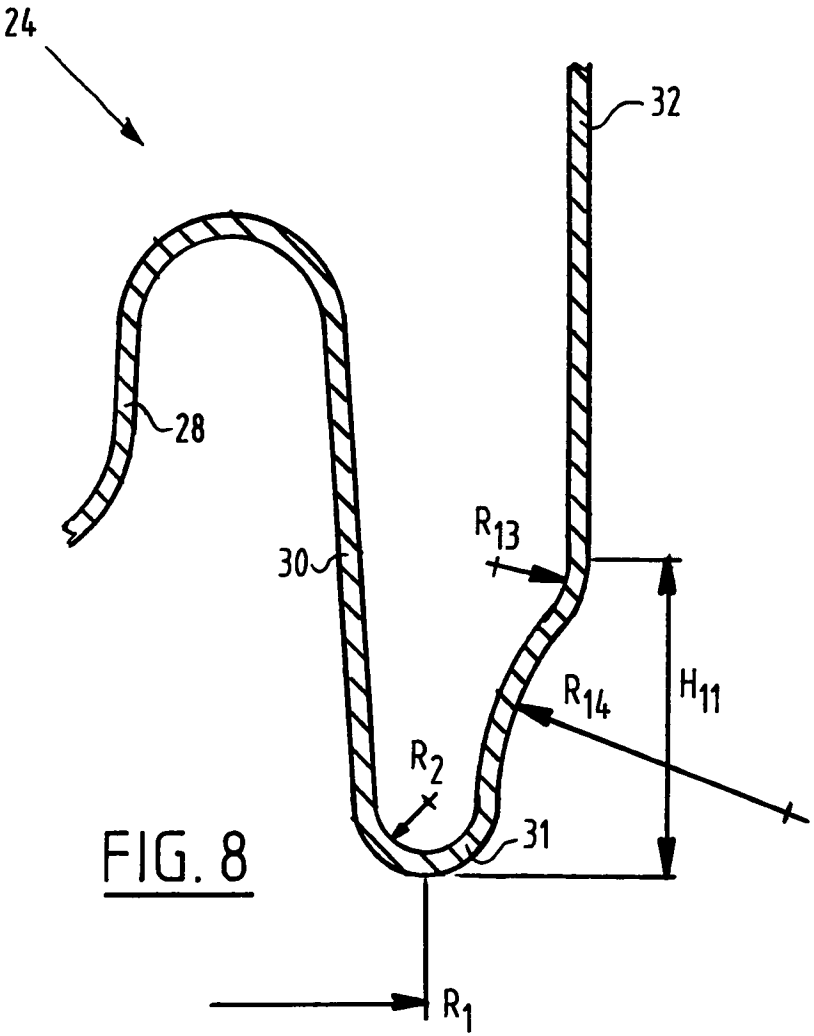

The following table shows the buckle (pressure) resistance of the can end 24 of FIGS. 6-8 at a wall thickness of 0.22 mm and dependent on the unit depth $H_1$ and the panel depth $H_2$.

| Thickness | H1 (mm) | H2 (mm) | Buckle pressure (bar) |
|---|---|---|---|
| 0.22 | 5.6 | 3 | 52 |
| 0.22 | 6 | 3 | 53 |
| 0.22 | 6.4 | 3 | 54 |
| 0.22 | 6.8 | 3 | 55 |
| 0.22 | 6 | 2.6 | 52 |
| 0.22 | 6 | 2.8 | 52 |
| 0.22 | 6 | 3 | 53 |
| 0.22 | 6 | 3.2 | 54 |

Figure 9:
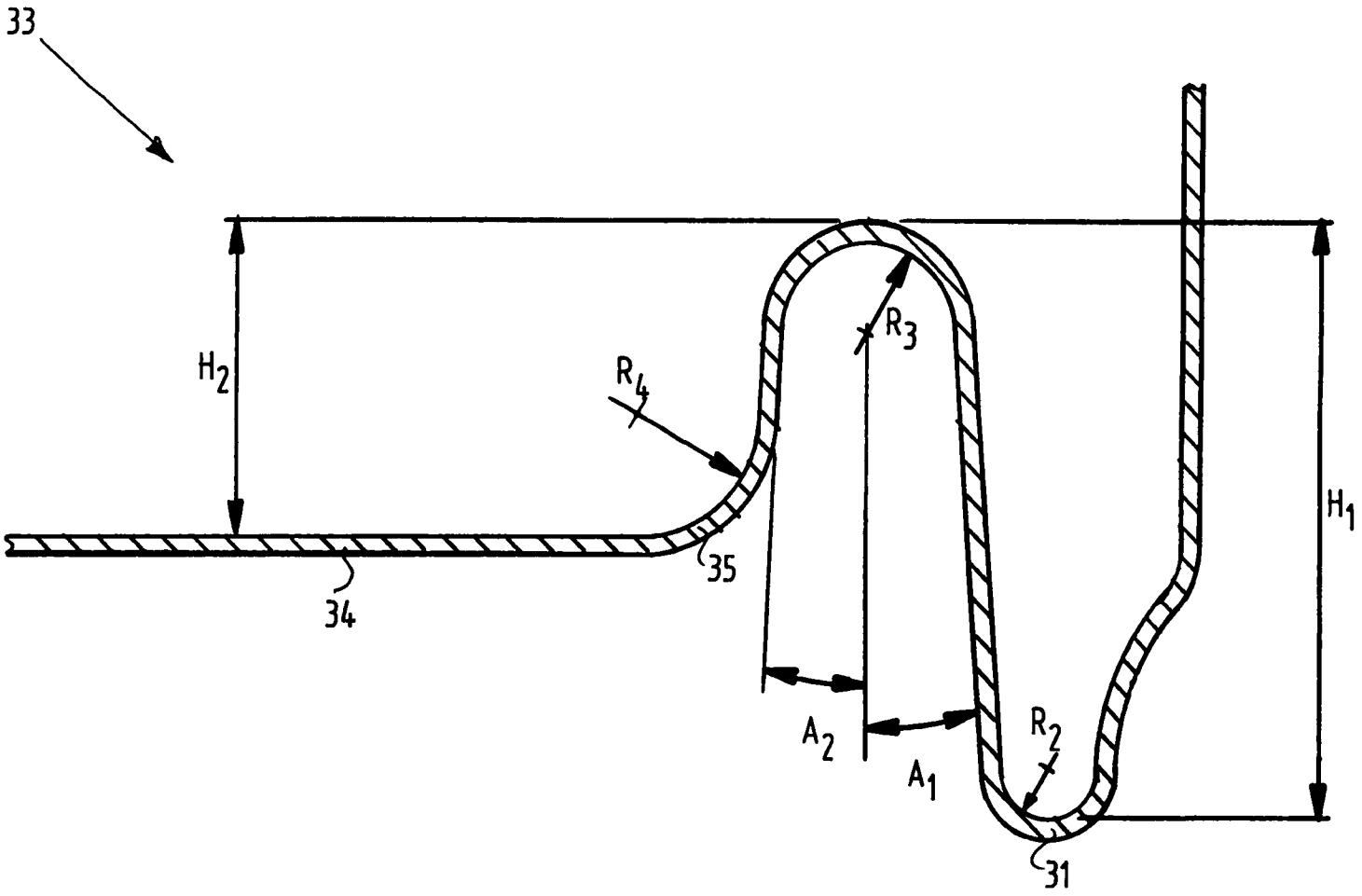
FIG. 9 is an alternative embodiment of the can bottom of FIG. 7.

FIG. 9 shows an alternative can bottom 33 according to the invention. This can bottom 33 comprises a panel 34 which is directly connected to a panel radius 35. Accordingly, this panel 34 does not comprise a panel ring.

Figure 10:
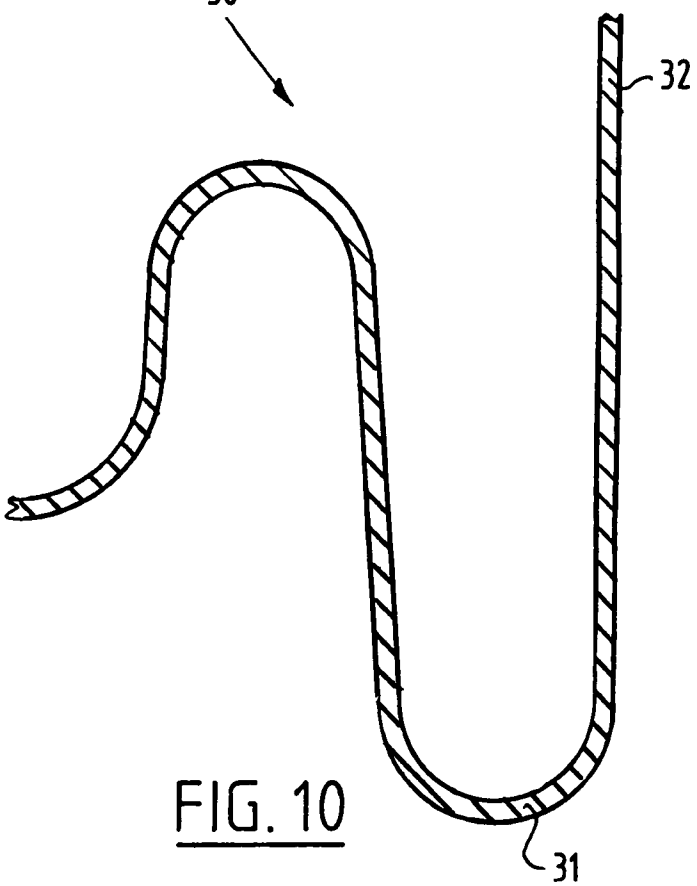
FIGS. 10 and 11 are an alternative embodiment of the can bottom of FIG. 8.

FIG. 10 shows still another embodiment of a can bottom 36 according to the invention. In this embodiment the can end/foot radius 31 is directly connected to the body wall 32 of the can. Accordingly, this can bottom 36 does not comprise the foot radius $R_{13}$ and the outer foot radius $R_{14}$ (see FIG. 7).

Figure 11:
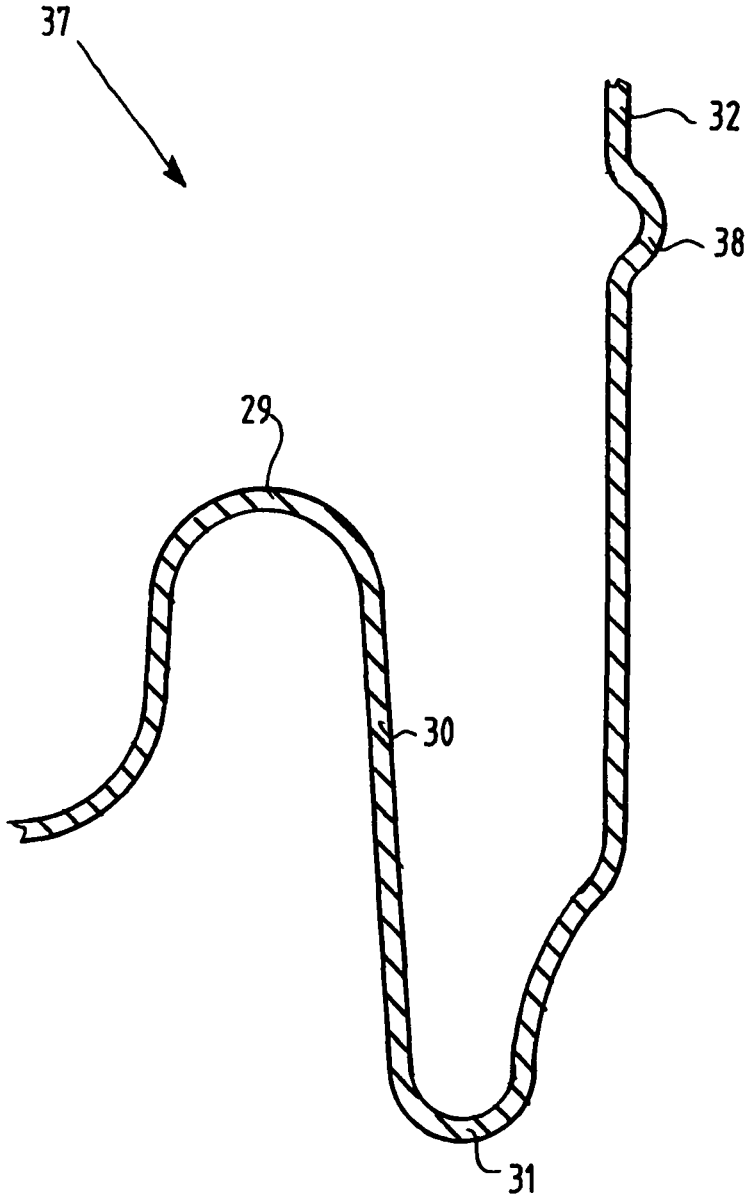

FIG. 11 shows still another alternative embodiment in the form of a can bottom 37 in comparison to the can bottom 24 of FIG. 8, the can bottom 37 comprises in the body wall 32 a rolling bead 38 for guiding the closed can provided with the can bottom 37 during processing in a continues cooker.

Figure 12:
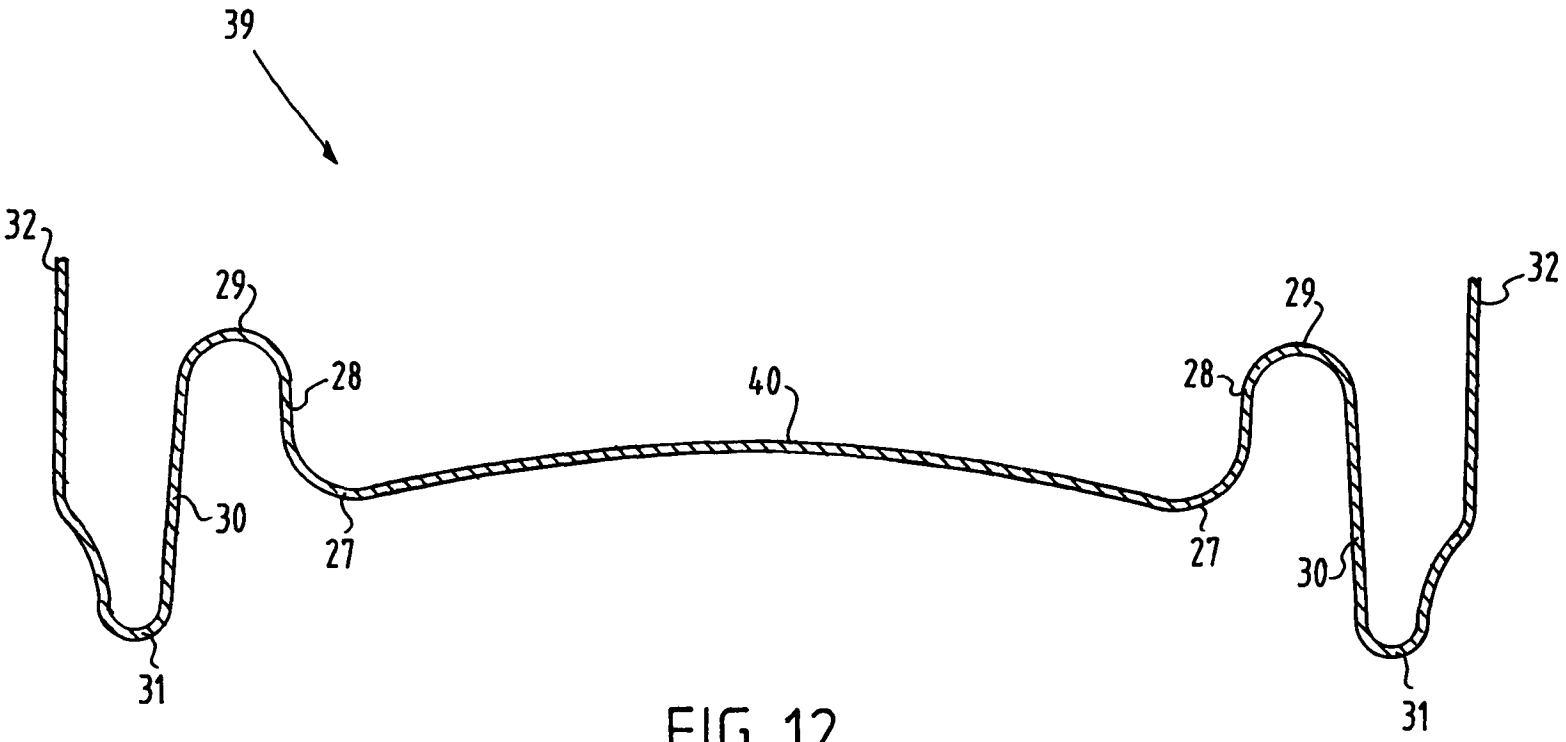
FIG. 12 is an alternative embodiment of the can bottom of FIG. 6.

FIG. 12 shows another embodiment of a can bottom 39 of the invention. This can bottom 39 comprises a body wall 32 and a can end/foot radius 31 connected via a transition or chuck wall 30 and a counter sink radius 29 to a panel wall 28. The panel wall 28 is connected via a panel radius 27 to a central panel 40. In comparison to the can bottom 24 of FIG. 6 this panel has a convex shape as the integral can bottom 17 (not according to the invention) as illustrated for the can 15 of FIG. 4.

Figure 13:
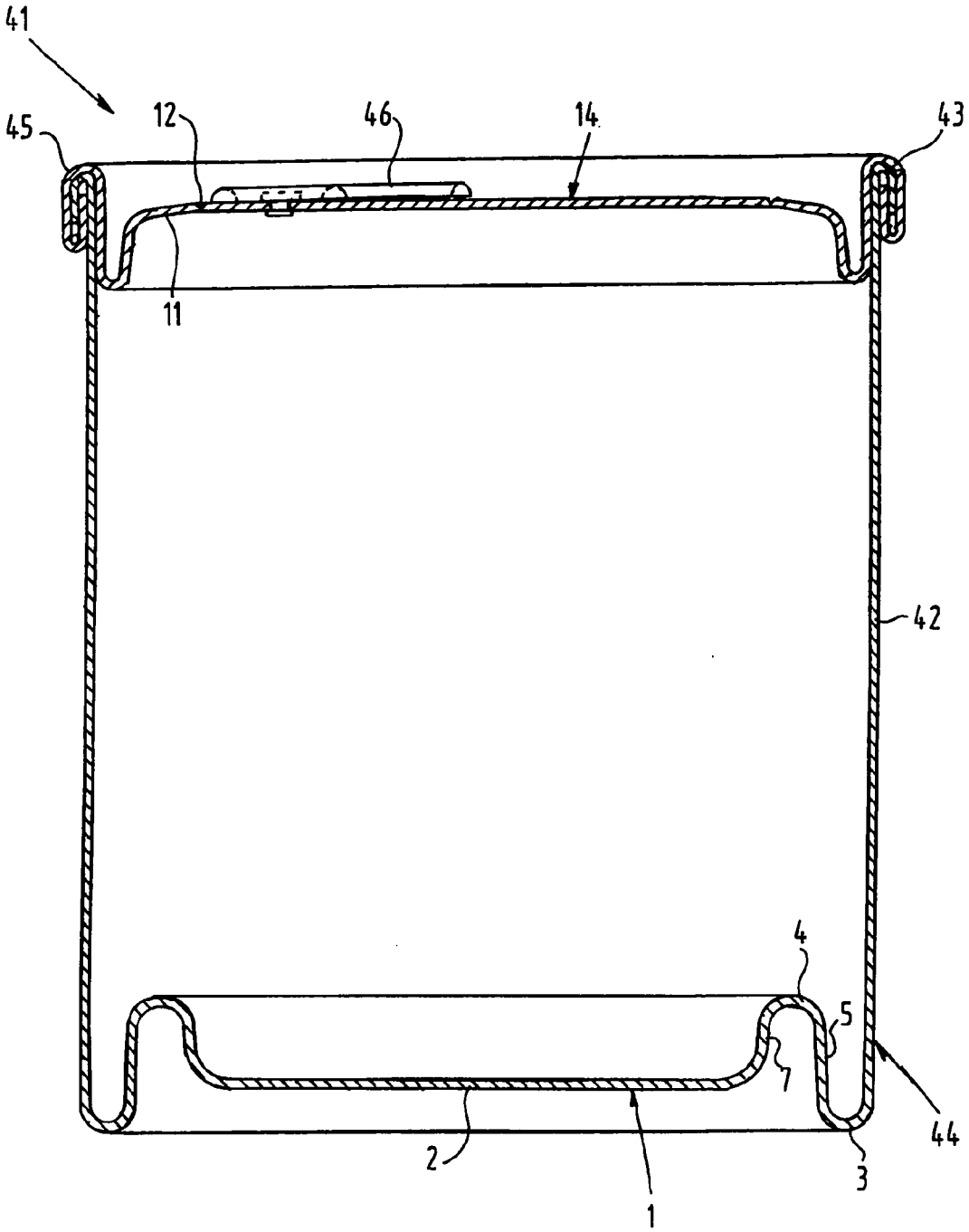
FIG. 13 is in cross section a can according to the invention provided with a can lid of FIG. 3 and as a can bottom the can lid of FIG. 1 (integrally formed with the can body)

FIG. 13 shows a can 41 comprising a body wall 42 provided with a can lid 43 and an integral can bottom 44. The can lid 43 is a can lid 14 as shown in FIG. 3. The can lid 14 is connected by a seam 45 to the body wall 42. The can lid 14 is provided with an opening tab 46 for opening the can 41 via an opening determined by a score line 12 formed in panel outer ring 11. The can bottom 44 is a can end 1 as presented in FIG. 1 as a can lid but integrally formed with the body wall 42. The can end 1 comprises the panel 2 connected via the panel wall 7 and the counter sink 4 and the transition wall 5 to the curl or can end radius 3 which integrally is connected to the body wall 42.

Figure 14:
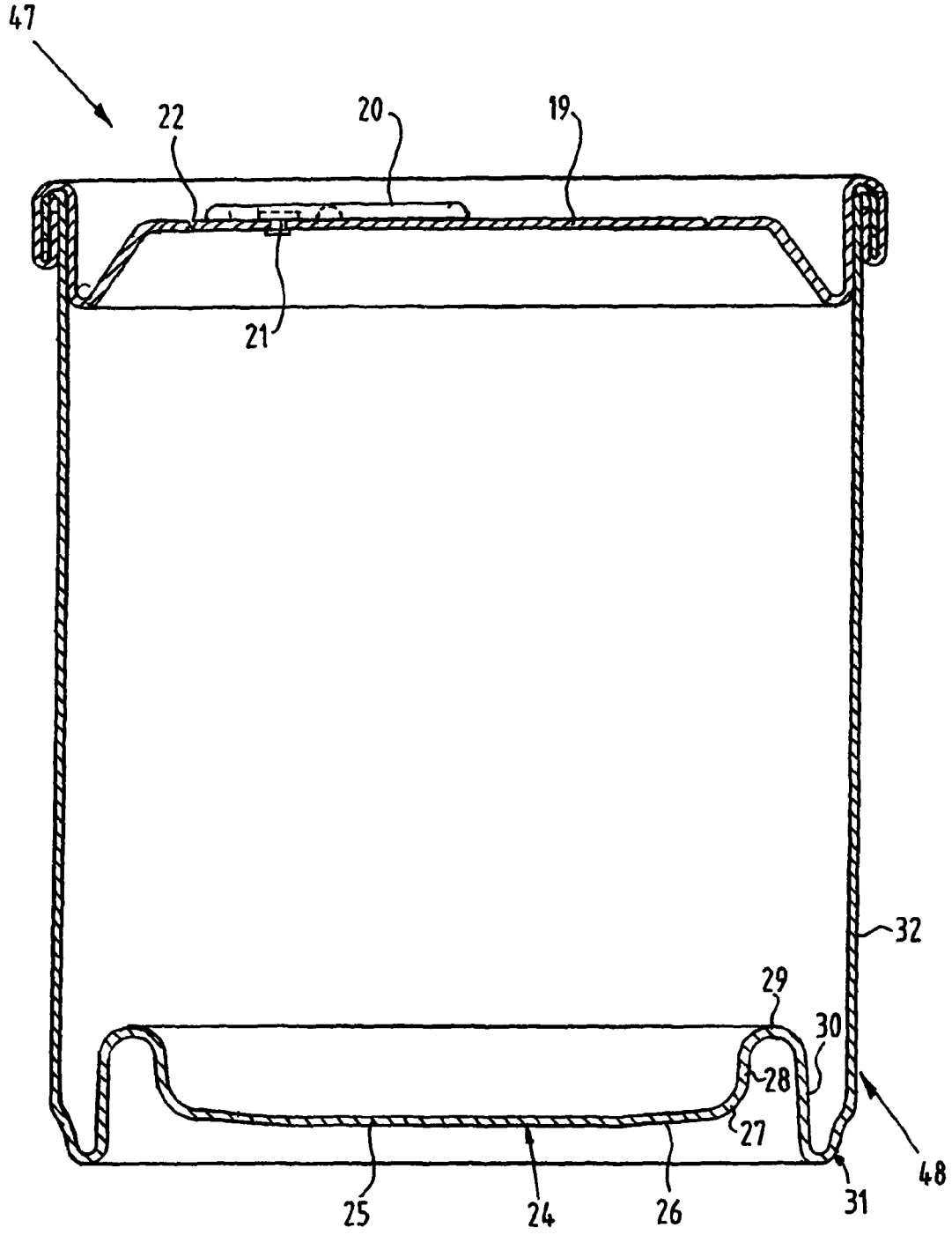
FIG. 14 is a can according to the invention as an alternative to the can of FIG. 4 having as a can bottom the can bottom of FIG. 6.

FIG. 14 shows another can 47 according to the invention. It is an alternative to the can 15 shown in FIG. 4. In this alternative the can bottom 48 is formed by the can bottom 24 as shown in FIG. 6.

Figure 15:
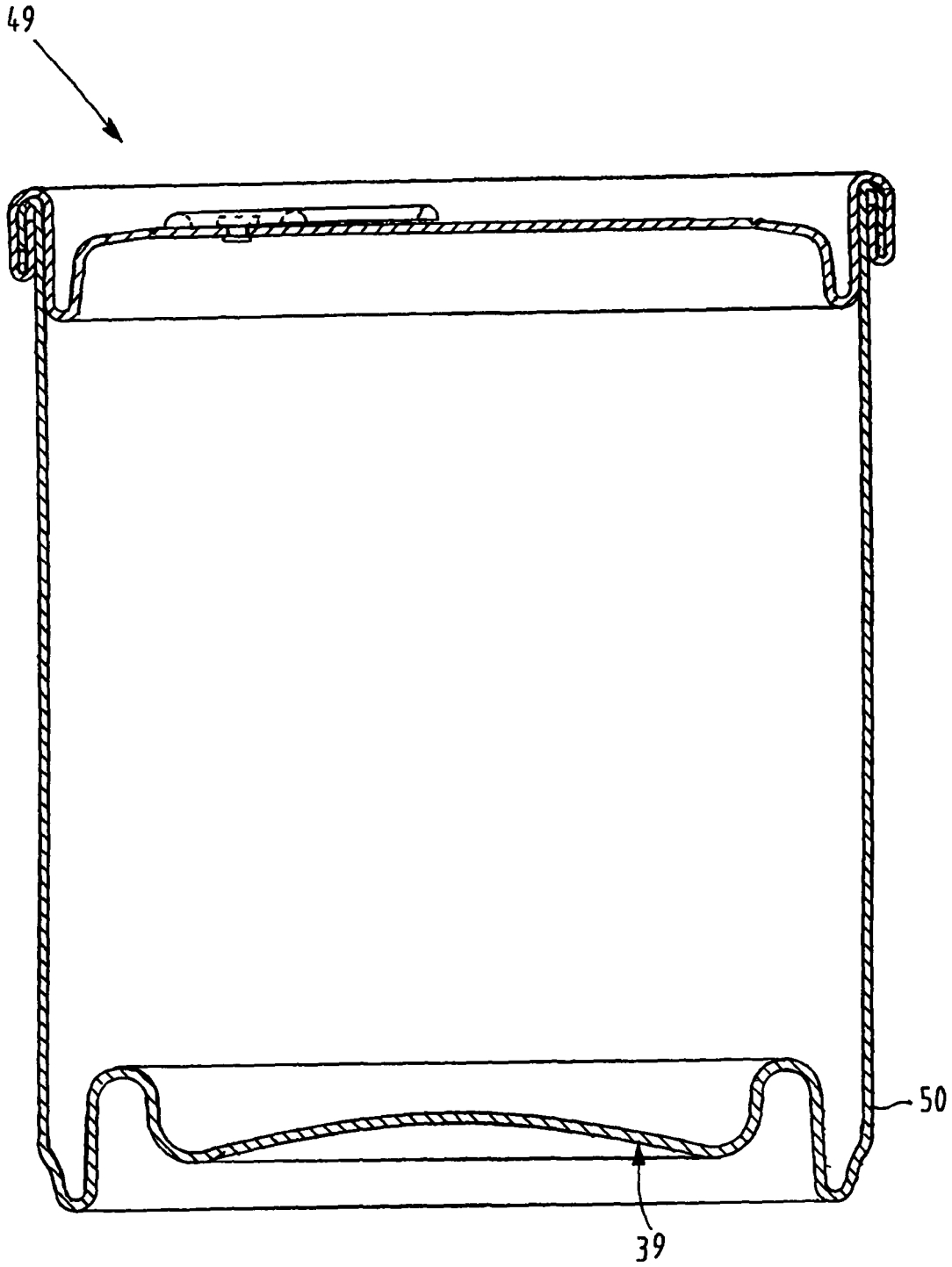
FIG. 15 is a can according to the invention provided with a can lid according to FIG. 3 and a can bottom according to FIG. 12.

FIG. 15 shows another can 49 according to the invention which is an alternative to the can 44 of FIG. 13. In this case the can bottom 50 has the form of the can bottom 39 as illustrated in FIG. 12.

Figure 16:
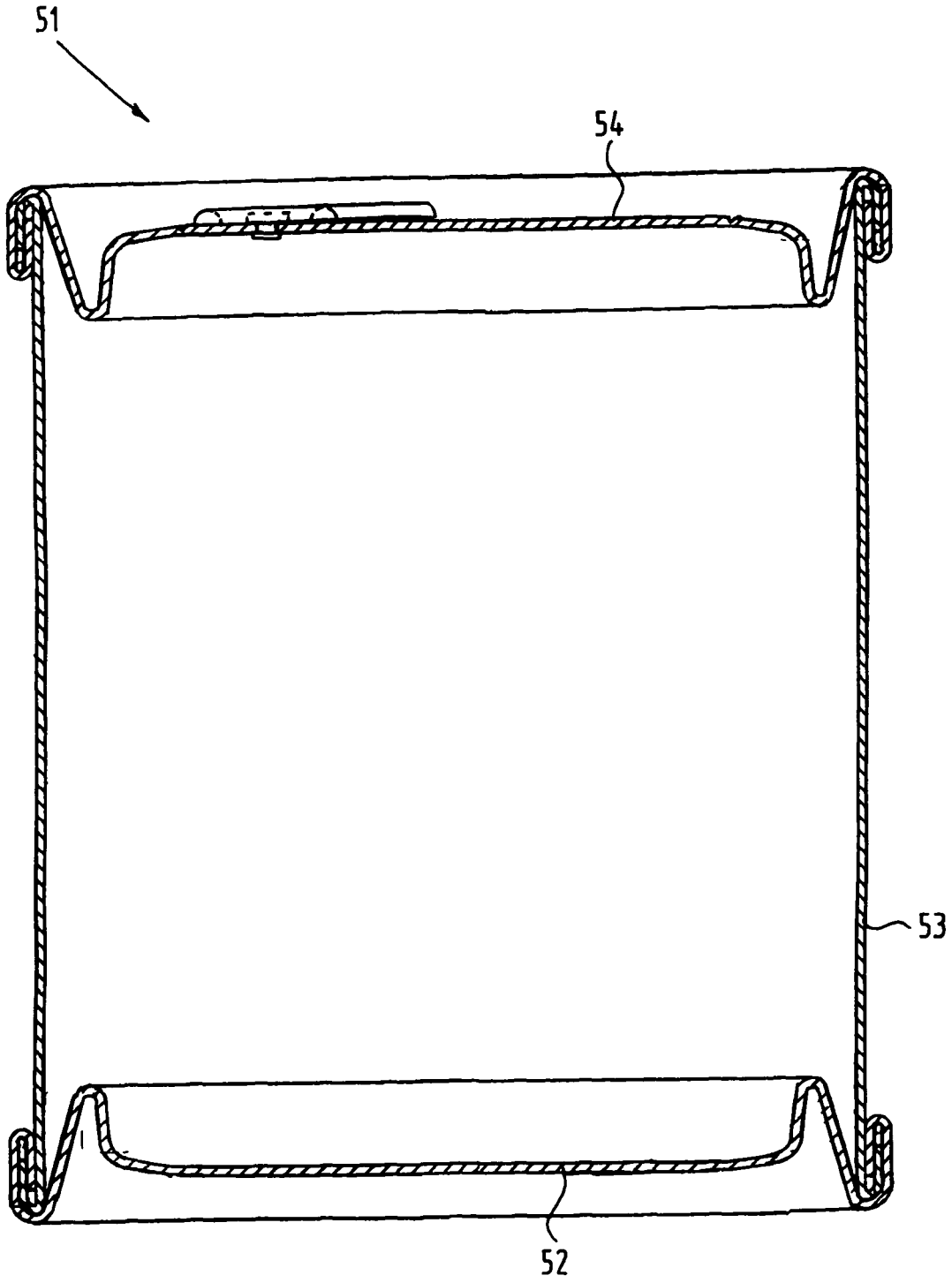
FIG. 16 is a can according to the invention with two can ends seamed to the can body.

Finally, FIG. 16 shows a can 51 according to the invention in which a can lid 54 and a can bottom 52 are both seamed to a can body 53.

It is noted that the various can lids and can bottoms could be manufactured by standard technologies by drawing from a disc shape metal part using various dies for forming the various can end structures. Each can end may be used as can lid and/or can bottom as is desired.

The metal used may be of any suitable metal such as aluminum, steel, plated steel. The metal may be provided with a coating in the form of a lacquer or plastic layer as is traditionally used for food and beverage cans.

The invention claimed is:

1. A can end for a can comprising:

a flat or concave central panel;

a can end radius for connection to a body of the can; and a countersink connected via a transition wall to the can end radius and via a straight panel wall to the central panel, wherein the panel wall extends from the countersink to the central panel at a panel wall angle ($A_2$, $P_2$) of 2°-45°, a panel radius ($R_4$) of a curvature between the panel wall and central panel is 1.0-1.5 mm, a panel depth ($H_2$) from the countersink to the central panel including a thickness of the central panel is 1 mm-7 mm, and a single countersink radius ($R_3$) of a curvature between the countersink and transition wall is in a range of 0.5 mm to 5 mm, and wherein the countersink radius determines an internal curvature of a section between the straight wall panel and the transition wall, and wherein an outer panel ring extends from the central panel at a panel outer ring slope ($A_3$) of 2°-20° and has a panel outer ring width ($L_1$) of 1-15 mm.

2. The can end as claimed in claim 1, wherein the panel wall angle ($A_2$, $P_2$) is 5°-35°.

3. The can end as claimed in claim 1, wherein the can end is a can bottom, and the can end radius forms a foot and the foot has an end foot radius ($R_2$) which is less than 5 mm.

4. The can end as claimed in claim 3, wherein the countersink radius ($R_3$) is 0.5-1.5 mm.

5. The can end as claimed in claim 3, wherein the panel depth ($H_2$) is 2-5 mm.

6. The can end as claimed in claim 3, wherein a foot radius ($R_{13}$) is less than 5 mm.

7. The can end as claimed in claim 3, wherein the foot height ($H_{11}$) is 1-7 mm.

8. The can end as claimed in claim 3, wherein a unit depth ($H_1$) from the countersink to the foot is 2-10 mm.

9. The can end as claimed in claim 1, wherein the panel outer ring width ($L_1$) is 1-5 mm.

10. The can end as claimed in claim 1, wherein the can end is a can lid.

11. The can end as claimed in claim 10, wherein the panel depth ($H_2$) is 2.0-2.5 mm.

12. The can end as claimed in claim 10, wherein the countersink radius ($R_3$) is 0.5-0.7 mm.

13. The can end as claimed in claim 10, wherein a unit depth ($H_1$) from the countersink to a top portion of a seaming panel connected to the transition wall is 5-7 mm.

14. The can end as claimed in claim 10, wherein an outer panel ring extends from the central panel at a panel outer ring slope ($P_3$) of 0°-35° and has a panel outer ring width ($L_1$) of 0-15 mm.

15. The can end as claimed in claim 14, wherein the panel outer ring slope ($P_3$) is 2°-20°.

16. A can comprising a body and at least one can end comprising:

a flat or concave central panel;

a can end radius for connection to a body of the can; and a countersink connected via a transition wall to the can end radius and via a straight panel wall to the central panel, wherein the panel wall extends from the countersink to the central panel at a panel wall angle ($A_2$, $P_2$) of 2°-45°, a panel radius ($R_4$) of a curvature between the panel wall and central panel is 1.0 mm to 1.5 mm, a panel depth ($H_2$) from the countersink to the central panel including a thickness of the central panel is 1 mm-7 mm, and a single countersink radius ($R_3$) of a curvature between the countersink and transition wall is in a range of 0.5 mm to 5 mm, and wherein the countersink radius determines an internal curvature of a section between the straight wall panel and the transition wall, and wherein an outer panel ring extends from the central panel at a panel outer ring slope ($A_3$) of 2°-20° and has a panel outer ring width ($L_1$) of 1-15 mm.

17. The can as claimed in claim 16, wherein the at least one can end is at least one of a can lid or a can bottom.

18. The can as claimed in claim 16, wherein the can comprises a first can lid covering a top portion thereof and a second can lid covering a bottom portion thereof.

19. The can as claimed in claim 16, wherein the can comprises a can lid and a can bottom.

20. The can according to claim 19, wherein the can lid or can bottom is integral with the body of the can.

* * * * *